US009505590B2

(12) United States Patent
Chen

(10) Patent No.: US 9,505,590 B2
(45) Date of Patent: Nov. 29, 2016

(54) WALL CLEANER HANGING STRUCTURE

(76) Inventor: Shun-Yuan Chen, Taipei (TW)

( * ) Notice: Subject to any disclaimer, the term of this patent is extended or adjusted under 35 U.S.C. 154(b) by 1113 days.

(21) Appl. No.: 13/605,258

(22) Filed: Sep. 6, 2012

(65) Prior Publication Data

US 2014/0061429 A1 Mar. 6, 2014

(51) Int. Cl.

| | |
|---|---|
| ***B66F 5/00*** | (2006.01) |
| ***B66C 23/20*** | (2006.01) |
| ***E04G 23/00*** | (2006.01) |
| ***E04G 3/34*** | (2006.01) |

(52) U.S. Cl.

CPC ..... *B66C 23/205* (2013.01); *B66C 23/208* (2013.01); *E04G 3/34* (2013.01); *E04G 23/002* (2013.01)

(58) Field of Classification Search

USPC ..... 254/84

See application file for complete search history.

(56) References Cited

U.S. PATENT DOCUMENTS 2,170,689 A * 8/1939 Loomis ..... E04G 3/34 182/12
2,928,564 A * 3/1960 Figge ..... B66C 23/205 414/615
3,302,750 A * 2/1967 Arnold ..... B66C 23/205 182/112
4,112,535 A * 9/1978 Wild ..... E04G 23/002 134/172
4,198,724 A * 4/1980 Fisher ..... A47L 1/02 15/103
4,926,957 A * 5/1990 Urakami ..... B62D 57/024 114/222
4,979,589 A * 12/1990 Sugiyama ..... E04G 5/12 182/138
5,065,838 A * 11/1991 Finley ..... E04G 3/34 182/142
5,249,326 A * 10/1993 Jefferies ..... A47L 1/02 15/103
5,465,446 A * 11/1995 Chang ..... A47L 1/02 15/103
5,901,720 A * 5/1999 Lange ..... A47L 1/02 118/307
RE36,649 E * 4/2000 Jefferies ..... A47L 1/02 15/103
6,986,186 B1 * 1/2006 Dube ..... A47L 1/02 15/250.01
7,231,683 B1 * 6/2007 Cruz ..... A47L 1/02 15/103
8,985,273 B2 * 3/2015 Terry ..... A47L 3/02 182/150
2002/0032942 A1 * 3/2002 Lee ..... A47L 1/02 15/50.3
2007/0006408 A1 * 1/2007 Yu ..... E04G 23/002 15/103

FOREIGN PATENT DOCUMENTS

WO WO 0117698 A1 * 3/2001 ..... A47L 1/02

* cited by examiner

*Primary Examiner* — Alvin Grant
(74) *Attorney, Agent, or Firm* — Schmeiser, Olsen & Watts, LLP

(57) ABSTRACT

A wall cleaner hanging structure for hanging a wall cleaner includes a frame; at least a fastening unit for fastening the wall cleaner hanging structure in place; a liquid storage device for storing and conveying a liquid for washing a wall surface; a cable elevation device for controlling vertical movement of the wall cleaner; a tube and wire elevation device for controlling the length of a wire and a delivery tube; a plurality of guiding wheels for guiding the wire and the delivery tube to the wall cleaner; and a wall cleaner moving device for adjusting the distance between the wall cleaner and the wall surface. The wall cleaner hanging structure is freely moved and stored, works in conjunction with the wall cleaner to wash the wall surface in an automated manner, such that wall cleaning workers are less likely to get injured and fall victim to work accidents.

16 Claims, 6 Drawing Sheets

1

2

WALL CLEANER HANGING STRUCTURE

FIELD OF THE INVENTION

The present invention relates to hanging structures, and more particularly, to a wall cleaner hanging structure for hanging a wall cleaner.

BACKGROUND OF THE INVENTION

The prior art for use in cleaning the external walls of a building entails carrying out a wall cleaning process by hand. The manual wall cleaning process involves mounting a simple hanging structure at the top of the building, attaching a movable wall cleaning platform to the hanging structure, and eventually cleaning the external walls of the building by a wall cleaning worker working on the movable wall cleaning platform.

The conventional wall cleaning platform serves the following purposes: an elevation cable, a detergent, and a brush are positioned on the conventional wall cleaning platform; and a hose extends from the top floor to the wall cleaning platform, such that the wall cleaning worker can clean the external walls of the building with water sprayed out of the hose.

Normally, the conventional hanging structure can be moved along a rail fixed to the top floor of the building and thus cannot be uninstalled. Furthermore, even if the wall cleaning platform is not in use, the conventional hanging structure will still remain on the top floor of the building and thus will be exposed to rainfall and sunshine; as a result, the conventional hanging structure is likely to rot or rust.

Furthermore, the wall cleaning platform is usually separated from the adjacent external wall of the building by a distance, and thus the wall cleaning worker has to clean the adjacent external wall of the building, using a brush with a long handle. Cleaning an external wall of a building with a long-handle brush is not only time-consuming and laborious but also proves ineffective in cleaning a specially-located external wall or an external wall of a special shape.

The aforesaid conventional wall cleaning process is preceded by a wall cleaning platform moving process that requires the wall cleaning worker to manually control the elevation cable for moving the wall cleaning platform vertically. It is not uncommon for the wall cleaning platform moving process to be hazardous. For example, the wall cleaning worker working on the wall cleaning platform is likely to trip or even fall off the wall cleaning platform because the wall cleaning platform moving vertically shakes or because the detergent or water wets the wall cleaning platform. Furthermore, the elevation cable is likely to be splashed with the detergent or water and thus develops a short circuit to thereby end up with a failure.

Accordingly, it is imperative to devise a hanging structure which is movable and storable freely and effective in operating in conjunction with a wall cleaner for cleaning an external wall of a building in an automated manner with a view to preventing wall cleaning workers from getting injured while at work and reducing work accidents.

SUMMARY OF THE INVENTION

It is an objective of the present invention to provide a wall cleaner hanging structure which is movable and storable freely.

Another objective of the present invention is to provide a wall cleaner hanging structure for use with a wall cleaner in cleaning an external wall of a building in an automated manner.

Yet another objective of the present invention is to prevent wall cleaning workers from working at a dangerous workplace and thereby reducing work accidents.

In order to achieve the above and other objectives, the present invention provides a wall cleaner hanging structure for hanging a wall cleaner. The wall cleaner hanging structure comprises a frame, at least a fixing unit, a liquid storage device, a cable elevation device, a tube and wire elevation device, a plurality of guiding wheels, and a wall cleaner moving device.

The frame has a base, two vertical rods, and two extending rods. The vertical rods are disposed on and fixed to the base. The extending rods are disposed at the vertical rods, respectively, and positioned proximate to the free ends (that is, top ends) of the vertical rods 13, respectively.

The fixing unit comprises a weighting-down water tank, a wall surface clamp, or a combination thereof. The weighting-down water tank is disposed on the base. The wall surface clamp is disposed between the vertical rods.

The liquid storage device is disposed on the base or a movable base. The liquid storage device comprises: at least a container for holding a liquid for washing a wall surface; and at least a delivery tube connected to the container for conveying the liquid with a pump.

The cable elevation device is disposed on the base. The cable elevation device comprises: two cables connected to the wall cleaner; a cable withdrawing-releasing reel comprising two cable withdrawing-releasing portions for storing the cables, respectively, and being driven by an elevation motor to withdraw and release the cables; and a first transmission element disposed at an end of the cable withdrawing-releasing reel, wherein the first transmission element and the cable withdrawing-releasing reel are coaxial.

The tube and wire elevation device is disposed on the base or the cable elevation device. The tube and wire elevation device comprises: a tube-wire withdrawing-releasing reel having at least two tube-wire withdrawing-releasing portions for storing at least a wire and the delivery tube, respectively; and a second transmission element disposed at an end of the tube-wire withdrawing-releasing reel, wherein the second transmission element and the first transmission element are disposed on a same side of the tube-wire withdrawing-releasing reel, wherein the second transmission element and the tube-wire withdrawing-releasing reel are coaxial, wherein the second transmission element is connected to the first transmission element by a connecting element, such that the elevation motor drives the tube-wire withdrawing-releasing reel to withdraw and release the wire and the delivery tube while driving the cable withdrawing-releasing reel.

The guiding wheels are disposed between the vertical rods. The guiding wheels guide the cables, the wire, and the delivery tube, respectively.

The wall cleaner moving device straddles the extending rods. The wall cleaner moving device comprises: a mobile base; a mobile motor disposed on the mobile base or at the extending rods to drive the mobile base to move relative to the extending rods; and a plurality of moving-guiding rollers disposed on the mobile base and guiding the cables and, the at least a wire, and the delivery tube, respectively.

As regards the wall cleaner hanging structure of the present invention, the wall cleaner hanging structure further comprises a cable adjusting unit positioned freely between the cable elevation device and the wall cleaner moving device and having a plurality of adjusting-guiding rollers for adjusting a length of one of the cables.

As regards the wall cleaner hanging structure of the present invention, the vertical rods have a plurality of vertical fastening portions, respectively, and the wall surface clamp is fixed to the vertical rods, respectively, by one of the vertical fastening portions.

As regards the wall cleaner hanging structure of the present invention, the wall surface clamp has a plurality of horizontal fastening portions, respectively, and the wall surface clamp is fixed to the vertical rods, respectively, by one of the horizontal fastening portions.

As regards the wall cleaner hanging structure of the present invention, the wall cleaner hanging structure further comprises a plurality of height adjusting units disposed beneath the base.

As regards the wall cleaner hanging structure of the present invention, the frame further comprises a plurality of rollers disposed beneath the base.

As regards the wall cleaner hanging structure of the present invention, the frame further comprises a displacement motor disposed at the base to drive the rollers to move.

As regards the wall cleaner hanging structure of the present invention, the wall cleaner hanging structure further comprises a plurality of reinforcing rods for connecting the base to the vertical rods, connecting the base to the extending rods, connecting the vertical rods, connecting the extending rods, and connecting the vertical rods to the extending rods, respectively.

As regards the wall cleaner hanging structure of the present invention, the cable elevation device further comprises a screw and two cable combing portions, the screw being horizontally disposed between the cable withdrawing-releasing reel and the guiding wheels, and the cable combing portions being screwed to the screw, corresponding in position to the cable withdrawing-releasing portions, respectively, and being driven by a screw motor to move in a manner to allow the cables to be neatly stored in the cable withdrawing-releasing portions, respectively.

As regards the wall cleaner hanging structure of the present invention, the wall cleaner hanging structure further comprises an uninterruptable power supply (UPS) electrically connected to the elevation motor and the mobile motor.

As regards the wall cleaner hanging structure of the present invention, the wall surface clamp has a stopping element and a fixing element.

As regards the wall cleaner hanging structure of the present invention, the connecting element is a hinge.

In conclusion, a wall cleaner hanging structure provided by the present invention works in conjunction with an automated wall cleaner to wash a wall surface in an automated manner, such that wall cleaning workers are less likely to get injured and fall victim to work accidents.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
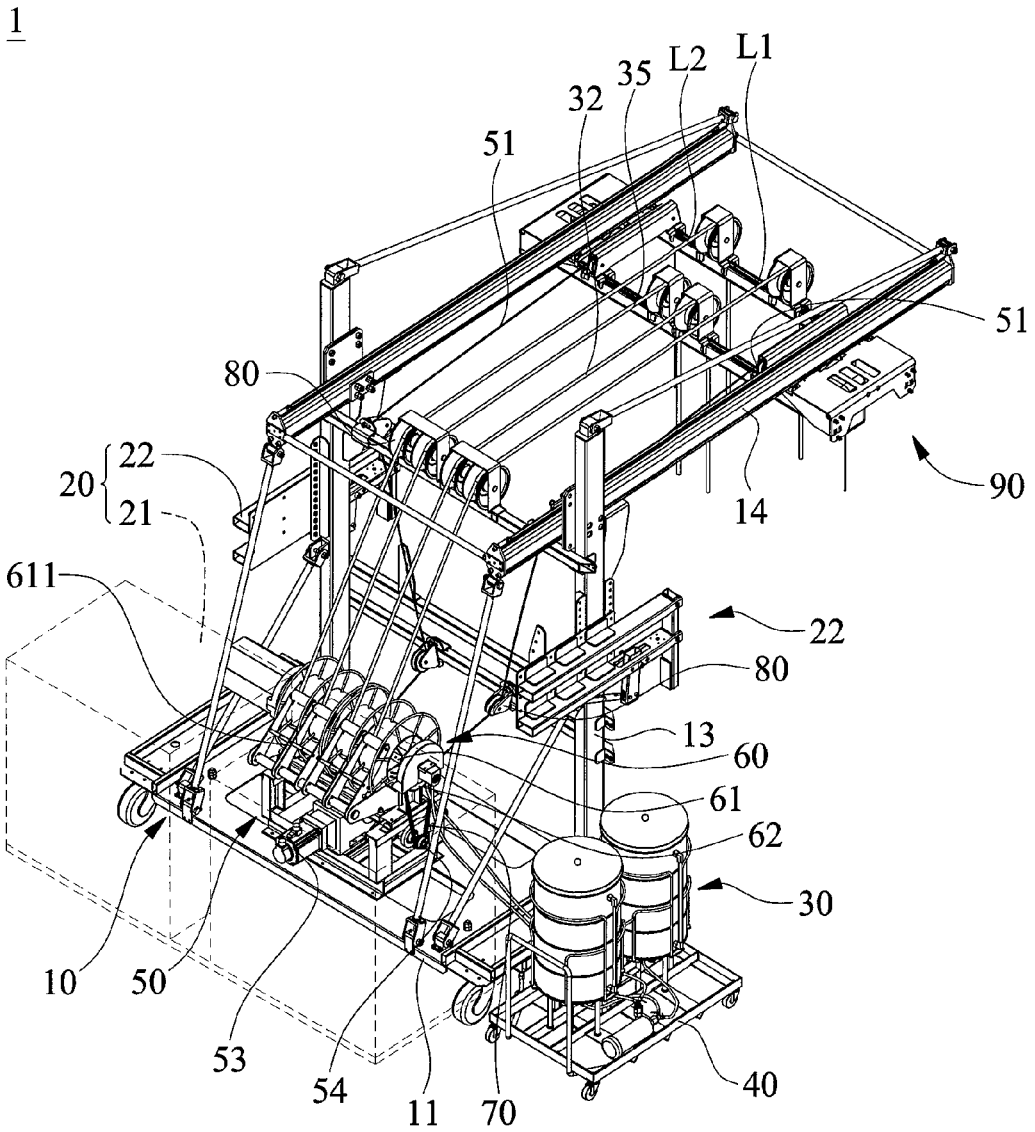
FIG. 1 is a schematic view of a wall cleaner hanging structure according to the first specific embodiment of the present invention.

Referring to FIG. 1 through FIG. 5, there are shown drawings of a wall cleaner hanging structure 1 according to the first specific embodiment of the present invention. The wall cleaner hanging structure 1 is for use in hanging a wall cleaner A (shown in FIG. 4.) The wall cleaner hanging structure 1 comprises a frame 10, at least a fixing unit 20, a liquid storage device 30, a cable elevation device 50, a tube and wire elevation device 60, a plurality of guiding wheels 80, and a wall cleaner moving device 90.

The frame 10 has a base 11, two vertical rods 13, and two extending rods 14. The vertical rods 13 are disposed on and fixed to the base 11 by welding, screwing, or snap engagement. Afterward, the extending rods 14 are fixed to the vertical rods 13, respectively, by welding, screwing, or snap engagement. The extending rods 14 are positioned proximate to the free ends (that is, top ends) of the vertical rods 13, respectively.

The fixing unit 20 comprises a weighting-down water tank 21, a wall surface clamp 22, or a combination thereof. The fixing unit 20 fixes the frame 10 in place and thus prevents the frame 10 from tilting or even tumbling under the weight of the wall cleaner A. The wall cleaner hanging structure 1 of the present invention is characterized in that: at least a weighting-down water tank 21 is disposed on the base 11 to weight down the frame 10 and thereby prevent the wall cleaner hanging structure 1 from tilting or tumbling; the wall surface clamp 22 is disposed between the vertical rods 13 to clamp a wall surface W, fix the frame 10 in place, and prevent the wall cleaner hanging structure 1 from tilting or tumbling; furthermore, the joint use of the weighting-down water tank 21 and the wall surface clamp 22 enhances the stability of the frame 10.

Figure 2:
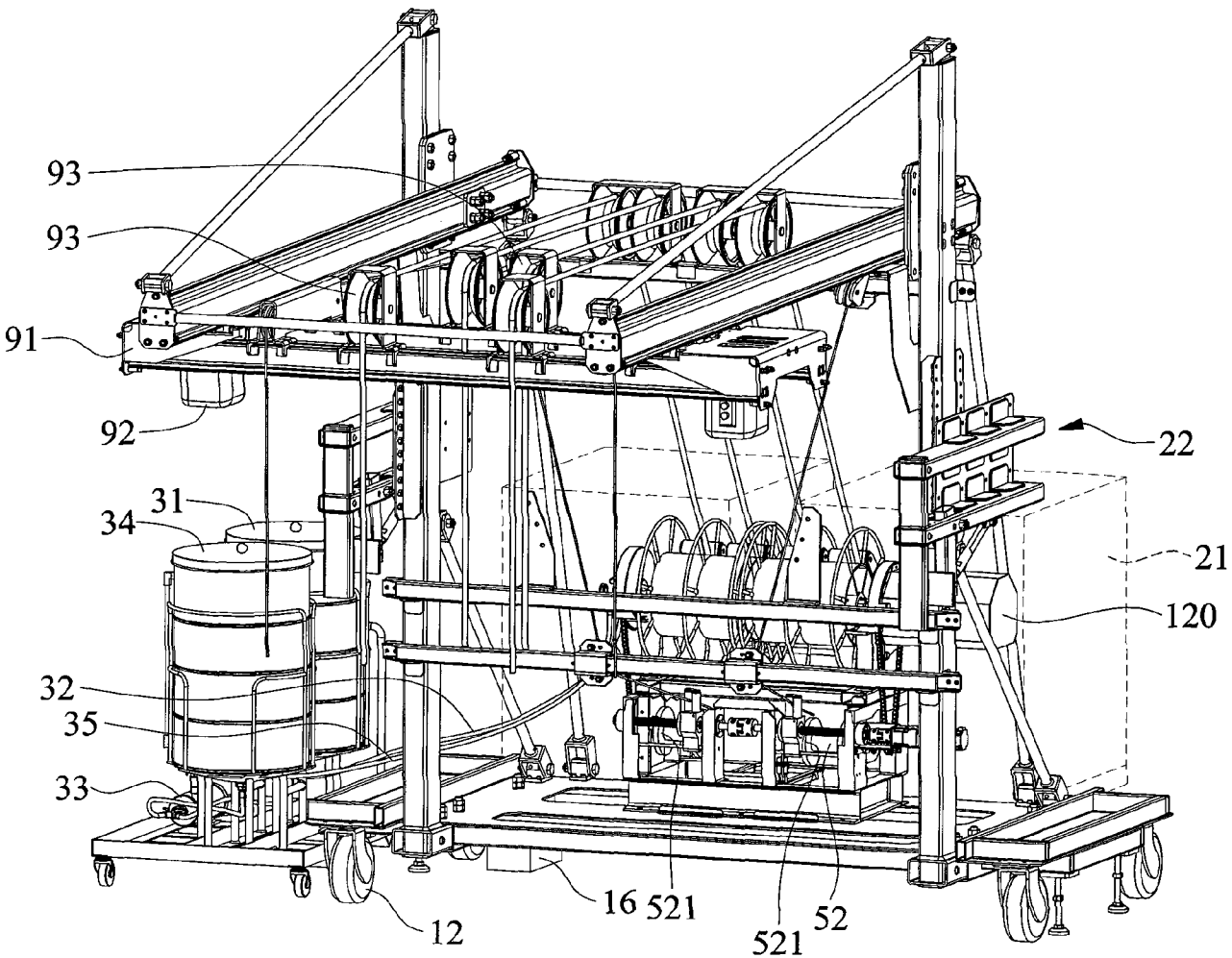
FIG. 2 is a schematic view of the wall cleaner hanging structure taken from another view angle according to the first specific embodiment of the present invention.

The liquid storage device 30 is disposed on a movable base 40 or is directly disposed on the base 11. The liquid storage device 30 comprises at least a container 31 and at least a delivery tube 32. The container 31 holds a liquid for washing the wall surface W, such as water, a glass detergent, a wall surface detergent, or an esthetic chemical. The delivery tube 32 connects the container 31 and the wall cleaner A. The delivery tube 32, coupled with a pump 33, conveys a liquid for washing the wall surface W. Referring to FIG. 2, the container 31 holds water and delivers the water to the wall cleaner A by means of the delivery tube 32, whereas another container 34 holds a wall surface detergent and delivers the wall surface detergent to the wall cleaner A by means of another delivery tube 35.

The cable elevation device 50 is disposed on the base 11 and fixed thereto by welding, screwing, or snap engagement. The cable elevation device 50 hangs the wall cleaner A by means of two cables 51. The cables 51 can be stored in two cable withdrawing-releasing portions 521 of a cable with-drawing-releasing reel 52, respectively. An elevation motor 53 drives the cable withdrawing-releasing reel 52 to withdraw and release the cables 51 and thereby enables the wall cleaner A to ascend and descend. Furthermore, the cable elevation device 50 has a first transmission element 54 disposed at an end of the cable withdrawing-releasing reel 52. The first transmission element 54 and the cable withdrawing-releasing reel 52 are coaxial. The first transmission element 54 is a gear.

The tube and wire elevation device 60 is fixed to the cable elevation device 50 by welding, screwing, or snap engagement, or is disposed on the base 11, wherein the tube and wire elevation device 60 comprises a tube-wire withdrawing-releasing reel 61 and a second transmission element 62.

The tube-wire withdrawing-releasing reel 61 has at least two tube-wire withdrawing-releasing portions 611. The tube-wire withdrawing-releasing portions 611 store at least a wire and the delivery tube 32, respectively. A wire intended to be handled with the tube and wire elevation device 60 is a power supply wire L1 or a task control wire L2 as needed. In an embodiment of the present invention, the wall cleaner A lacks a dedicated power source, and thus the power supply wire L1 supplies power to the wall cleaner A. In another embodiment of the present invention, the wall cleaner A lacks a dedicated control system, and thus the task control wire L2 sends a user's command to the wall cleaner A for executing an automated process, for example, controlling when to spray water with the wall cleaner A, controlling when to operate a rotary brush B, and controlling when to spray a detergent. Referring to FIG. 1, the present invention provides four said tube-wire withdrawing-releasing portions 611 for storing the power supply wire L1, the task control wire L2, and the delivery tubes 32, 35, respectively The second transmission element 62 is disposed at one end of the tube-wire withdrawing-releasing reel 61. The second transmission element 62 and the first transmission element 54 are positioned on the same side of the tube-wire withdrawing-releasing reel 61. The second transmission element 62 and the tube-wire withdrawing-releasing reel 61 are coaxial. The second transmission element 62 is a gear. The second transmission element 62 is connected to the first transmission element 54 by means of a connecting element 70 (such as a hinge.) Hence, the elevation motor 53 drives the tube-wire withdrawing-releasing reel 61 to withdraw and release the wire and the delivery tube 32, 35, while the elevation motor 53 is driving the cable withdrawing-releasing reel 52 to withdraw and release the cables 51.

The guiding wheels 80 are disposed between the vertical rods 13 and guide the cables 51, the wire (the power supply wire L1, the task control wire L2), and the delivery tube 32 to the wall cleaner A.

The wall cleaner moving device 90 straddles the extending rods 14 to control the distance between the wall cleaner A and the wall surface W. The wall cleaner moving device 90 comprises a mobile base 91, a mobile motor 92, and a plurality of moving-guiding rollers 93. The mobile motor 92 and the moving-guiding rollers 93 are disposed on the mobile base 91. The mobile motor 92 drives the mobile base 91 to move horizontally along the extending rods 14. The moving-guiding rollers 93 guide the cables 51, the wire (the power supply wire L1, the task control wire L2), and the delivery tube 32 to the wall cleaner A. Furthermore, it is also feasible that the mobile motor 92 is disposed at the extending rods 14 to drive, with a chain, the mobile base 91 to move horizontally (not shown).

The cables 51 are guided to move from the cable withdrawing-releasing portions 52 to the wall cleaner A by means of the guiding wheels 80 and the moving-guiding rollers 93, respectively.

The wires (such as a power supply wire L1 and a task control wire L2) are guided to move from the tube-wire withdrawing-releasing portions 611 to the wall cleaner A by means of the guiding wheels 80 and the moving-guiding rollers 93, respectively.

The delivery tubes 32, 35 are guided to move from the container 31, 34 to the wall cleaner A by means of the tube-wire withdrawing-releasing portions 611, the guiding wheels 80, and the moving-guiding rollers 93, respectively.

Figure 3:
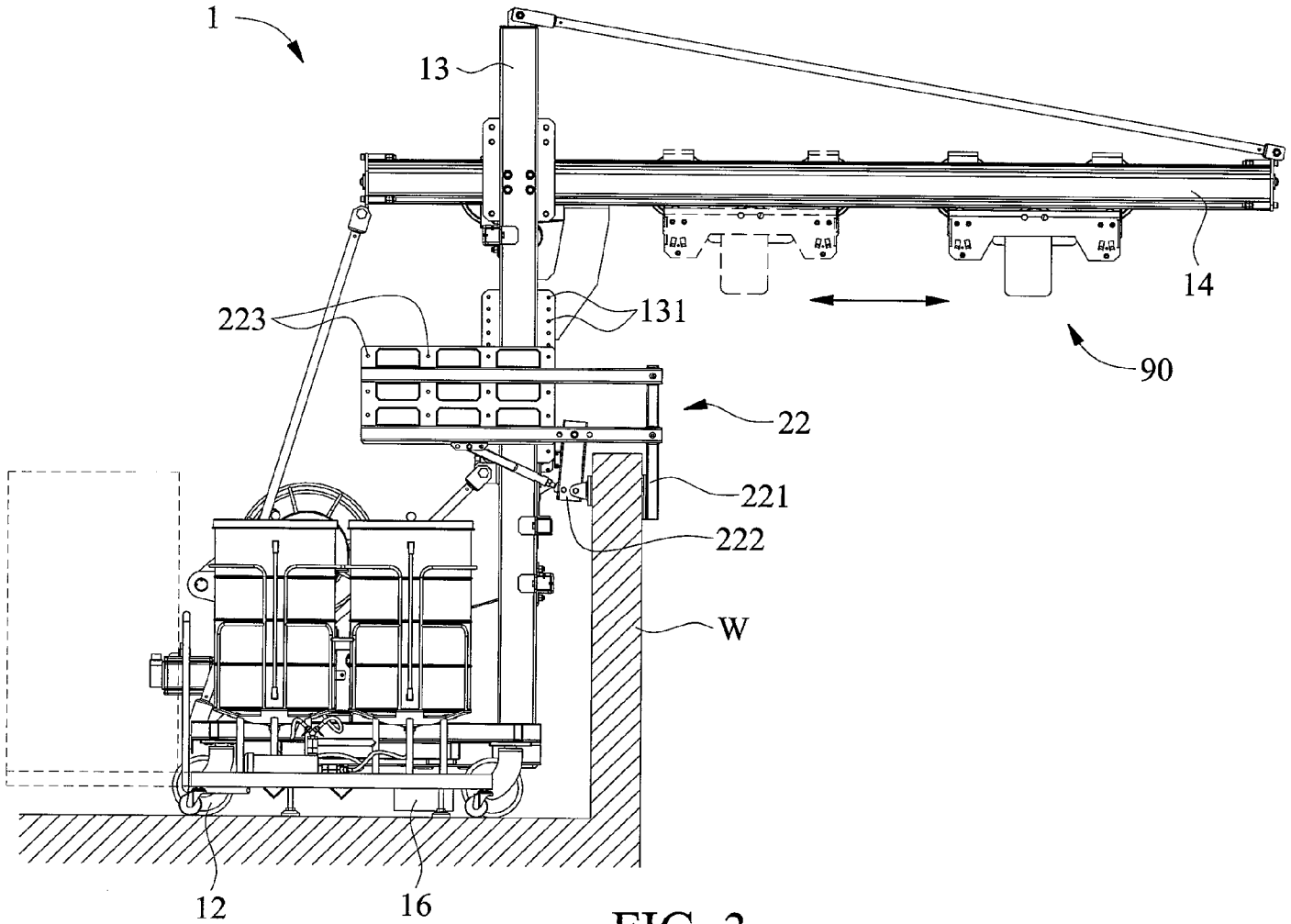
FIG. 3 is a lateral view of the wall cleaner hanging structure according to the first specific embodiment of the present invention.
Figure 4:
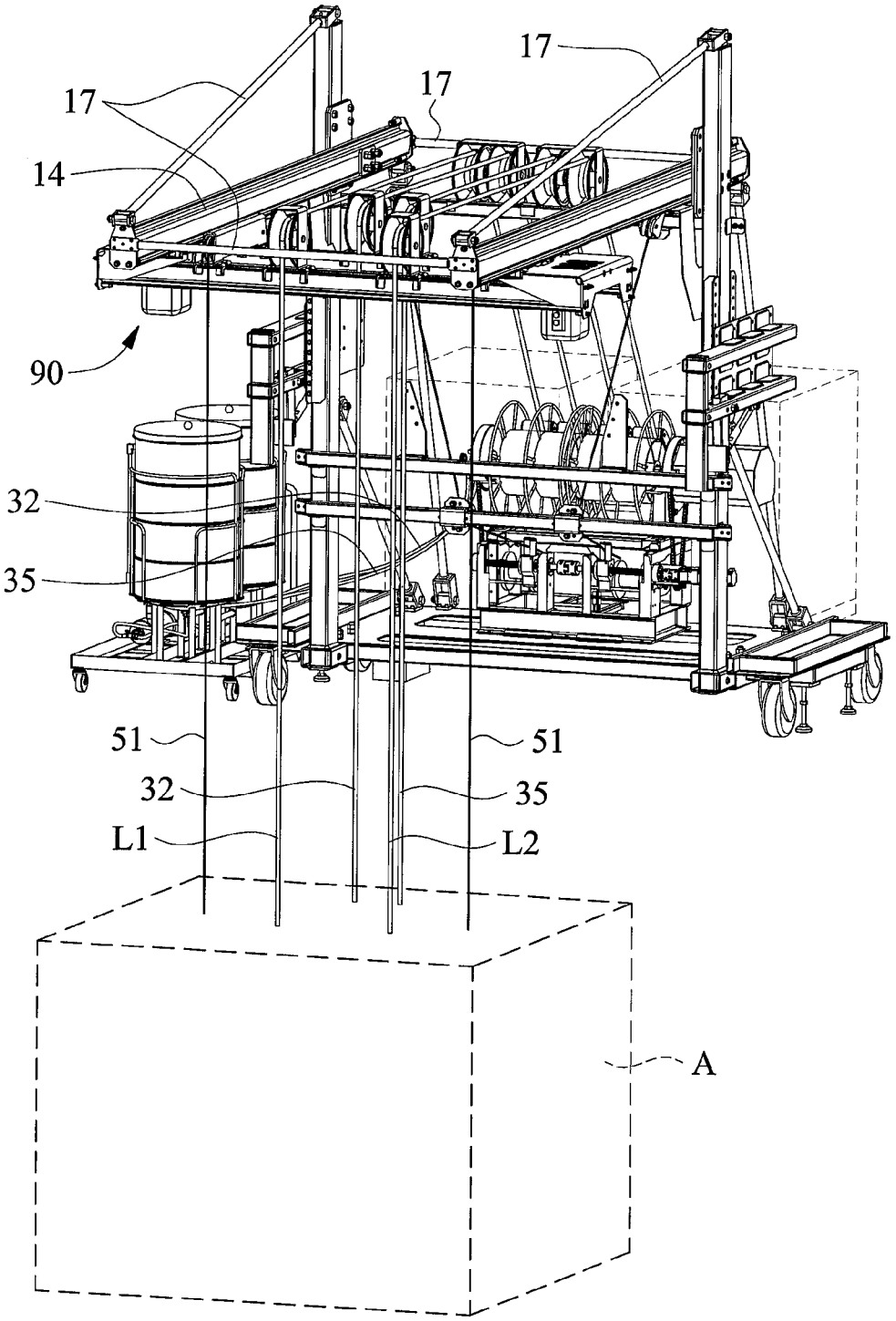
FIG. 4 is a schematic view of the wall cleaner hanging structure coupled to a wall cleaner according to the first specific embodiment of the present invention.
Figure 5:
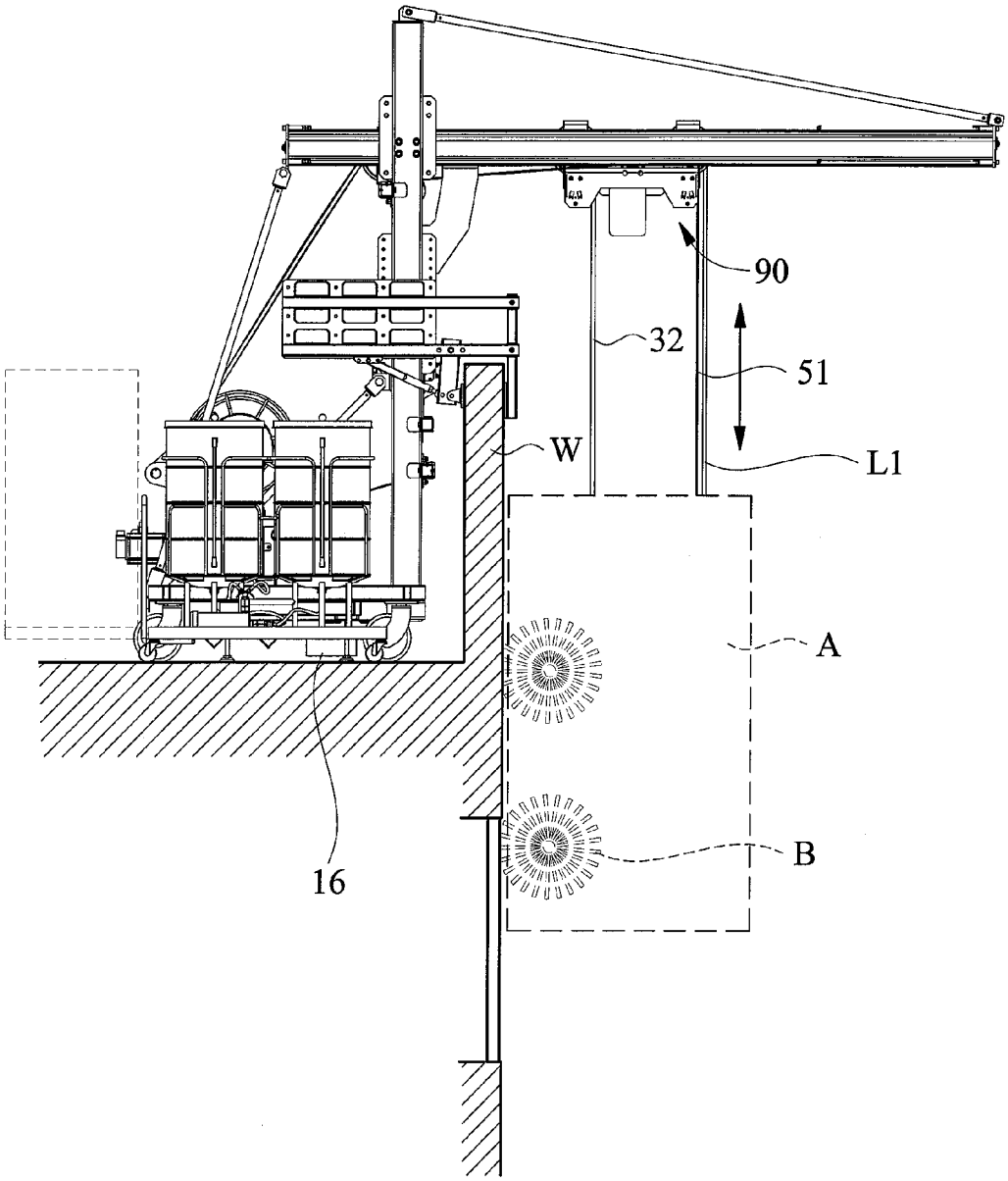
FIG. 5 is a schematic view of operation of the wall cleaner hanging structure and a wall cleaner according to the first specific embodiment of the present invention.

Referring to FIG. 3 through FIG. 5, to start washing the wall surface W of a building, a user of the wall cleaner hanging structure 1 of the present invention fixes a stopping element 221 of the wall surface clamp 22 to the outer side of the wall surface W, and then fixes a fixing element 222 of the wall surface clamp 22 to the inner side of the wall surface W manually, such that the wall cleaner hanging structure 1 is fixed in place.

Referring to FIG. 4, the wall cleaner A is hung beneath the wall cleaner moving device 90 with the cables 51, and the wires (such as the power supply wire L1 and the task control wire L2) and the delivery tubes 32, 35 are connected to the wall cleaner A.

Referring to FIG. 5, the user moves the wall cleaner moving device 90 to adjust the distance between the wall cleaner A and the wall surface W. The wall cleaner moving device 90 stops moving horizontally as soon as the brush B of the wall cleaner A comes into contact with the wall surface W. At last, the user configures the way of washing the wall surface W, for example, moving the wall cleaner A vertically, spraying water, spraying a detergent, and operating the rotary brush B.

After finishing the washing process performed on the wall surface W, the user dismounts the wall cleaner hanging structure 1 from the wall surface W in accordance with the aforesaid design, and then the user may mount the wall cleaner hanging structure 1 on another wall surface to be washed so as to perform the aforesaid washing process again. To render it easy to move the wall cleaner hanging structure 1, the frame 10 further comprises a plurality of rollers 12 disposed beneath the base 11; hence, not only can the wall cleaner hanging structure 1 move without a rail disposed on the top floor of the building, but the wall cleaner hanging structure 1 can be stored after the wall surface W has been washed.

In conclusion, the wall cleaner hanging structure 1 of the present invention can be freely moved and stored and can work in conjunction with the wall cleaner A to wash the wall surface W. Hence, with the wall cleaner hanging structure 1 of the present invention, wall cleaning workers will no longer work in a hazardous workplace and thus will be less likely to fall victim to a work accident.

Furthermore, the wall cleaner hanging structure 1 of the present invention further comprises a plurality of vertical fastening portions 131 vertically disposed at the vertical rods 13, respectively, such that the user can select the vertical fastening portions 131 according to the wall height and fix the wall surface clamp 22 to the vertical rods 13. Given the aforesaid design, the present invention is applicable to different wall heights.

Furthermore, the wall cleaner hanging structure 1 of the present invention further comprises a plurality of horizontal fastening portions 223 horizontally disposed on the wall surface clamp 22, such that the user can select the horizontal fastening portions 223 according to the wall shape and fix the wall surface clamp 22 to the vertical rods 13. Given the aforesaid design, the present invention is applicable to different wall shapes.

Furthermore, the wall cleaner hanging structure 1 of the present invention further comprises a displacement motor 16 disposed at the base 11 to drive the rollers 12 to move. Given the aforesaid design, the wall cleaner hanging structure 1 can move freely to thereby save manpower. Furthermore, the displacement motor 16 can operate in conjunction with a computer to thereby effectuate an automated control process for controlling the extent of the movement of the wall cleaner hanging structure 1.

Furthermore, the wall cleaner hanging structure 1 of the present invention further comprises a plurality of reinforcing rods 17 for reinforcing the structural strength of the frame 10. The reinforcing rods 17 connect the base 11 to the vertical rods 13, connect the base 11 to the extending rods 14, connect the vertical rods 13, connect the extending rods 14, and connect the vertical rods 13 to the extending rods 14, respectively.

Furthermore, the wall cleaner hanging structure 1 of the present invention further comprises an uninterruptable power supply (UPS) 120 electrically connected to the elevation motor 53 and the mobile motor 92. In case power interruption happens while the wall cleaner A is washing the wall surface W, the wall cleaner A will stay at the wall surface W and will be likely to cause an accident. Hence, the present invention is advantageously characterized in that the uninterruptable power supply (UPS) 120 supplies electric power to the elevation motor 53 and the mobile motor 92 to thereby move the wall cleaner A back to the top floor of a building and thus prevent any accidents.

Figure 6:
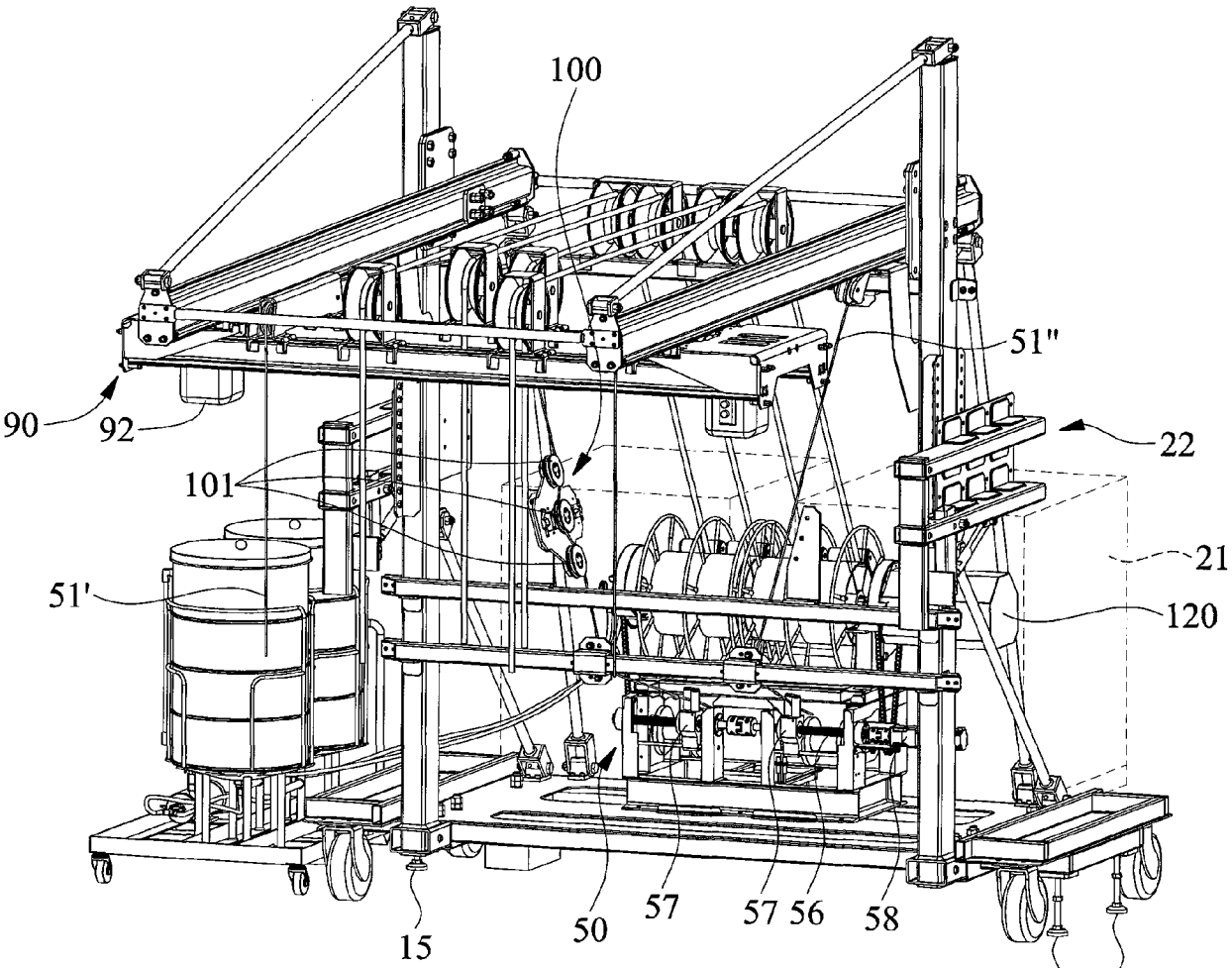
FIG. 6 is a schematic view of a wall cleaner hanging structure according to the second specific embodiment of the present invention.

Referring to FIG. 6, there is shown a schematic view of a wall cleaner hanging structure 2 according to the second specific embodiment of the present invention. The wall cleaner hanging structure 2 is substantially identical to the wall cleaner hanging structure 1 in terms of structure.

In the situation where the ground of the top floor on which the wall cleaner hanging structure 2 is positioned is uneven or slanted, the wall cleaner A hung by a left cable 51' and a right cable 51" is likely to tilt and cause an accident, because the left cable 51' and the right cable 51" are equal in the length of the released portions thereof. Hence, the present invention is advantageously characterized in that a cable adjusting unit 100 is positioned freely between the cable elevation device 50 and the wall cleaner moving device 90 to adjust the length of the left cable 51' or the length of the right cable 51", such that the wall cleaner A is unlikely to tilt.

Referring to FIG. 6, if the ground on which the wall cleaner hanging structure 2 is positioned slopes downward from left to right, the wall cleaner A will slope downward from left to right too. Hence, the cable adjusting unit 100 can be disposed between the vertical rods 13 and positioned closer to the left vertical rod 13 than the right vertical rod 13, so as to increase the number of the windings of the left cable 51' by means of a plurality of adjusting-guiding rollers 101 of the cable adjusting unit 100. As a result, the length of the left cable 51' is put under control to thereby make sure that the wall cleaner A will never tilt.

In the situation where the ground of the top floor on which the wall cleaner hanging structure 2 is positioned is slightly uneven or slanted, the wall cleaner hanging structure 2 of the present invention further comprises a plurality of height adjusting units 15 disposed beneath the base 11 and adapted to fine-tune the horizontality of the wall cleaner hanging structure 2. For example, referring to FIG. 6, if the ground on which the wall cleaner hanging structure 2 is positioned slopes downward from left to right, the user can lift the rightward ones of the height adjusting units 15 to keep the wall cleaner hanging structure 2 horizontal.

Furthermore, the wall cleaner hanging structure 2 of the present invention further comprises a screw 56 and two cable combing portions 57. The screw 56 is horizontally disposed between the cable withdrawing-releasing reel 52 and the guiding wheels 80. The cable combing portions 57 are screwed to the screw 56. The cable combing portions 57 correspond in position to the cable withdrawing-releasing portions 521, respectively. A screw motor 58 drives the cable combing portions 57 to move in the axial direction of the screw 56, such that the left cable 51' and the right cable 51" are neatly stored in the cable withdrawing-releasing portions 521, respectively.

In conclusion, a wall cleaner hanging structure provided by the present invention is freely moved or stored, operates in conjunction with a wall cleaner to wash a wall surface in an automated manner, and prevents wall cleaning workers from working in a hazardous workplace, so that the wall cleaning workers are less likely to fall victim to a work accident.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A wall cleaner hanging structure for hanging a wall cleaner, the wall cleaner hanging structure comprising:

a frame having a base, two vertical rods, and two extending rods, the vertical rods being disposed on the base, the extending rods being disposed at the vertical rods, respectively, and positioned proximate to free ends of the vertical rods, respectively;

at least a fixing unit comprising a weighting-down water tank, a wall surface clamp, or a combination thereof, the weighting-down water tank being disposed on the base, and the wall surface clamp being disposed between the vertical rods;

a liquid storage device disposed on one of the base and a movable base, the liquid storage device comprising:

at least a container for holding a liquid for washing a wall surface; and at least a delivery tube connected to the container for conveying the liquid with a pump;

a cable elevation device disposed on the base and comprising:

two cables connected to the wall cleaner;

a cable withdrawing-releasing reel comprising two cable withdrawing-releasing portions for storing the cables, respectively, and being driven by an elevation motor to withdraw and release the cables; and a first transmission element disposed at an end of the cable withdrawing-releasing reel, wherein the first transmission element and the cable withdrawing-releasing reel are coaxial;

a tube and wire elevation device disposed on the base or the cable elevation device and comprising:

a tube-wire withdrawing-releasing reel having at least two tube-wire withdrawing-releasing portions for storing at least a wire and the delivery tube, respectively; and a second transmission element disposed at an end of the tube-wire withdrawing-releasing reel, wherein the second transmission element and the first transmission element are disposed on a same side of the tube-wire withdrawing-releasing reel, wherein the second transmission element and the tube-wire withdrawing-releasing reel are coaxial, wherein the second transmission element is connected to the first transmission element by a connecting element, such that the elevation motor drives the tube-wire withdrawing-releasing reel to withdraw and release the wire and the delivery tube while driving the cable withdrawing-releasing reel;

a plurality of guiding wheels disposed between the vertical rods and guiding the cables, the at least a wire, and the delivery tube, respectively; and a wall cleaner moving device straddling the extending rods and comprising:

a mobile base;

a mobile motor disposed on the mobile base or at the extending rods to drive the mobile base to move relative to the extending rods; and a plurality of moving-guiding rollers disposed on the mobile base and guiding the cables and, the at least a wire, and the delivery tube, respectively.

2. The wall cleaner hanging structure of claim 1, wherein the wall cleaner hanging structure further comprises a cable adjusting unit positioned freely between the cable elevation device and the wall cleaner moving device and having a plurality of adjusting-guiding rollers for adjusting a length of one of the cables.

3. The wall cleaner hanging structure of claim 1, wherein the vertical rods have a plurality of vertical fastening portions, respectively, and the wall surface clamp is fixed to the vertical rods, respectively, by one of the vertical fastening portions.

4. The wall cleaner hanging structure of claim 2, wherein the vertical rods have a plurality of vertical fastening portions, respectively, and the wall surface clamp is fixed to the vertical rods, respectively, by one of the vertical fastening portions.

5. The wall cleaner hanging structure of claim 1, wherein the wall surface clamp has a plurality of horizontal fastening portions, respectively, and the wall surface clamp is fixed to the vertical rods, respectively, by one of the horizontal fastening portions.

6. The wall cleaner hanging structure of claim 2, wherein the wall surface clamp has a plurality of horizontal fastening portions, respectively, and the wall surface clamp is fixed to the vertical rods, respectively, by one of the horizontal fastening portions.

7. The wall cleaner hanging structure of claim 3, wherein the wall surface clamp has a plurality of horizontal fastening portions, respectively, and the wall surface clamp is fixed to the vertical rods, respectively, by one of the horizontal fastening portions.

8. The wall cleaner hanging structure of claim 4, wherein the wall surface clamp has a plurality of horizontal fastening portions, respectively, and the wall surface clamp is fixed to the vertical rods, respectively, by one of the horizontal fastening portions.

9. The wall cleaner hanging structure of claim 1, wherein the wall cleaner hanging structure further comprises a plurality of height adjusting units disposed beneath the base.

10. The wall cleaner hanging structure of claim 1, wherein the frame further comprises a plurality of rollers disposed beneath the base.

11. The wall cleaner hanging structure of claim 10, wherein the frame further comprises a displacement motor disposed at the base to drive the rollers to move.

12. The wall cleaner hanging structure of claim 1, wherein the wall cleaner hanging structure further comprises a plurality of reinforcing rods for connecting the base to the vertical rods, connecting the base to the extending rods, connecting the vertical rods, connecting the extending rods, and connecting the vertical rods to the extending rods, respectively.

13. The wall cleaner hanging structure of claim 1, wherein the cable elevation device further comprises a screw and two cable combing portions, the screw being horizontally disposed between the cable withdrawing-releasing reel and the guiding wheels, and the cable combing portions are led by the screw, corresponding in position to the cable withdrawing-releasing portions, respectively, and being driven by a screw motor to move in a manner to allow the cables to be neatly stored in the cable withdrawing-releasing portions, respectively.

14. The wall cleaner hanging structure of claim 1, wherein the wall cleaner hanging structure further comprises an uninterruptable power supply (UPS) electrically connected to the elevation motor and the mobile motor.

15. The wall cleaner hanging structure of claim 1, wherein the wall surface clamp has a stopping element and a fixing element.

16. The wall cleaner hanging structure of claim 1, wherein the connecting element is a hinge.

* * * * *